United States Patent [19]

Seilly

[11] 4,064,473

[45] Dec. 20, 1977

[54] TRANSFORMER WITH WINDINGS IN HELICAL SLOTS OF CORE

[75] Inventor: Alec Harry Seilly, North Wembley, England

[73] Assignee: Lucas Industries Limited, Birmingham, England

[21] Appl. No.: 775,092

[22] Filed: Mar. 7, 1977

[30] Foreign Application Priority Data

Nov. 27, 1976 United Kingdom ..... 49586/76

[51] Int. Cl.[2] ..... H01F 21/06; H01F 27/30

[52] U.S. Cl. ..... 336/83; 336/135; 336/212; 336/221; 336/233

[58] Field of Search ..... 336/65, 83, 130, 132, 336/134, 135, 136, 220, 221, 212, 233, 234

[56] References Cited

U.S. PATENT DOCUMENTS

| | | | |
|---|---|---|---|
| 2,568,310 | 9/1951 | Whiffen | 336/83 |
| 2,594,915 | 4/1952 | Guillemant | 336/83 |

*Primary Examiner*—Thomas J. Kozma

[57] ABSTRACT

An electrical transformer comprises a core structure formed from magnetizable material and comprising a first annular element in the peripheral surface of which is formed at least a pair of helical slots. The core structure includes a second element which closes the open ends of the slots and located in each slot is at least two windings forming the primary and secondary windings of the transformer. Each winding extends along one slot and returns along the adjacent slot.

10 Claims, 2 Drawing Figures

TRANSFORMER WITH WINDINGS IN HELICAL SLOTS OF CORE

This invention relates to electrical transformers of the kind having a core structure formed from magnetizable material and at least a pair of electric windings wound upon the core structure one of said windings forming the primary winding of the transformer and the other winding or windings forming the secondary winding or windings.

The object of the present invention is to provide an electrical transformer in a simple and convenient form.

According to the invention in an electrical transformer of the kind specified the core structure comprises a first element of tubular form which is shaped to define an even number of helical slots arranged in the manner of a two or a multiple of two, start thread, and a second element of tubular form extending across the open ends of said slots, each winding extending along one of said slots and returning along an adjacent slot.

Figure 1:
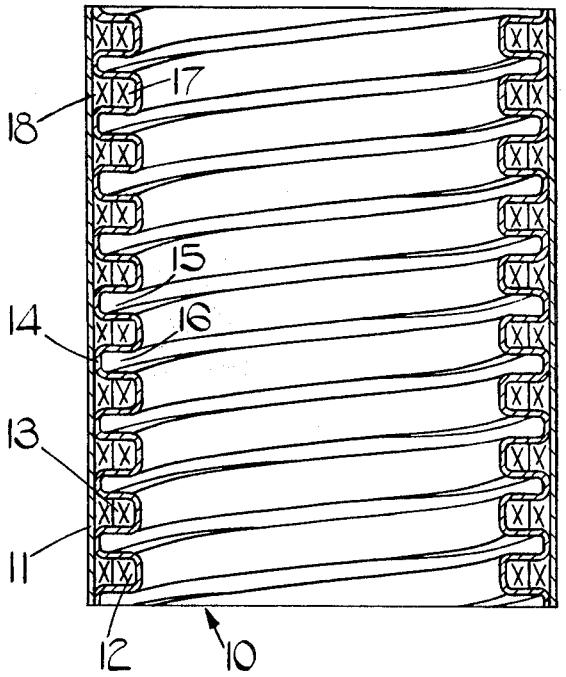
Figure 2:
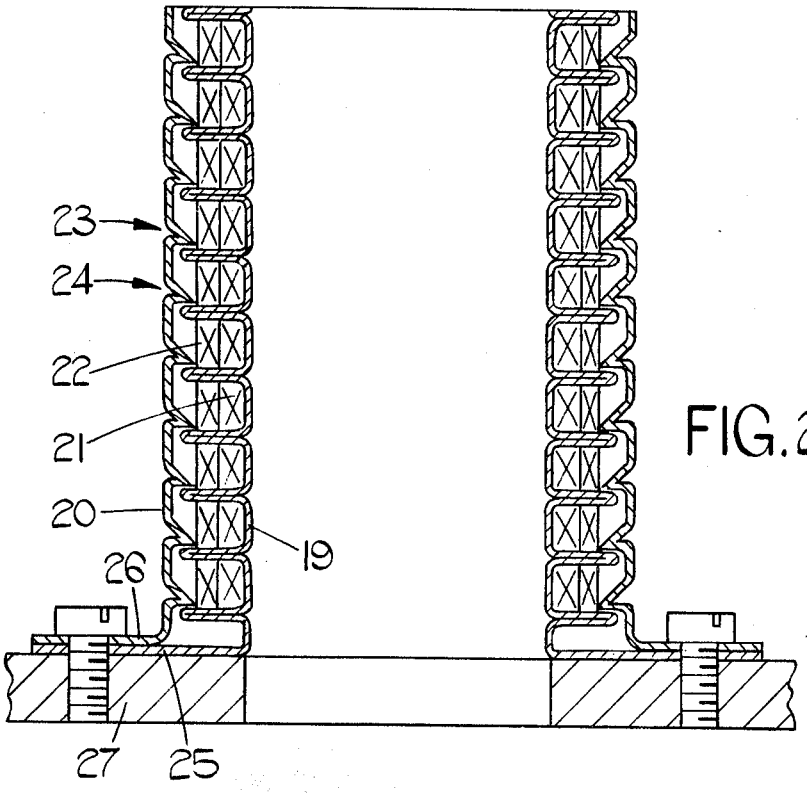

Two examples of transformer in accordance with the invention will now be described with reference to the accompanying drawings in which FIG. 1 and 2 show sectional side elevations respectively.

With reference to FIG. 1 of the drawings the transformer comprises a core structure comprising a first element 10 and a second element 11 the latter being of right cylindrical form. Both elements are formed from magnetizable material of a section such that the iron loss in the material when the transformer is in use, is as small as possible. If additional core material is required then the thickness of the material is increased but it is laminated.

The first and second elements are of annular form and as previously mentioned the second element is of right cylindrical form. The first element is disposed within the second element and has formed in its outer surface a pair of helical slots 12, 13 which are arranged in the manner of a two start screw thread; each slot has two side walls and a base wall. The open ends of the slots are closed by the second element. Conveniently the first element is formed by rolling the grooves or slots in the wall of a right cylindrical former which may be of laminated construction if the thickness of the material required in the magnetic circuits is such that substantial iron loss would occur when the transformer is in operation.

It will be noted from the drawing that the slots 12, 13 are of substantially "U" shape and that the outer edges of the adjacent walls of the slots are interconnected by a bridge portion indicated at 14. The bridge portions are of helical form and the internal surfaces of the bridge portions define the base walls of internal slots 15, 16 which are not occupied by windings. These slots being open allow cooling air access to the side walls of the slots 12, 13.

Located within the slots 12, 13 are the windings of the transformer. As shown there is one secondary winding indicated at 17, the primary winding being indicated at 18. There is a portion of each winding in each slot and whilst the primary winding is shown as being wound over the secondary winding the positions of these two windings can be reversed.

Each winding can be a single or multi-turn winding and in carrying out the winding operation the wire is wound along one slot from one end of the core structure and returns to the same end of the core structure along the other slot. This process is repeated in the case of a multi turn winding until the required number of turns is obtained. When the inner winding has been wound insulation is applied and the outer winding is wound. When winding is completed the second element is engaged over the first element with the bridge portions engaging the inner surface of the second element to complete the magnetic circuits.

The winding arrangement is such that the direction of current flow in the portions of the windings in the slots 12, 13 is in the opposite direction. The direction of flux flow in the adjacent side walls of the slots 12, 13 is therefore in the same direction and so there is no cancellation of the flux.

Turning now to FIG. 2 of the drawings, the transformer shown therein is provided with air gaps in its magnetic circuits. The air gaps are adjustable so that a measure of variation in the voltage developed between the ends of the secondary winding can be achieved when the transformer is under load. With reference to FIG. 2 first and second elements 19, 20 are provided and as in the example of FIG. 1 the first element defines helical slots 21, 22 which accommodate the windings.

In the embodiments of FIG. 2 the first element 19 has a different construction and whilst the slots 22, 21 are of substantially "U" section the adjacent side walls of the slots are in engagement with each other. Moreover the bridge portions are omitted with the fold between the side walls as tight as possible. Moreover, the side walls of the slots are substantially parallel.

The second element 20 is also of a different construction being shaped to define two helical projections 23, 24. As shown each projection comprises a first wall which extends substantially parallel to the side walls of the slots and a second wall which inclines away from the first wall to the main wall of the element. The walls of the slots 21, 22 extend outwardly beyond the windings which they contain and the projections locate within the slots, the two elements being interengaged in the manner of a screw and nut. At one end the first element 19 is provided with an outwardly extending flange portion 25 and the second element is provided with a similar flange 26. The two flanges are held in assembly by means of bolts whereby they are also secured to a base 27. The aperture for the bolts in one of the flanges are elongated whereby the two elements can be rotated relative to each other. It will be noted that the first wall of the projection 24 is disposed adjacent a side wall of the slot 21 and the first wall of the projection 23 adjacent a side wall of the slot 22. As a result the magnetic circuit defined by the wall of each slot includes two air gaps.

The size of the air gaps can be varied by relative angular adjustment of the two elements this being allowed by slackening the aforesaid bolts. The size of the air gaps could be adjusted by altering the relative axial setting of the two elements.

Moreover, as with the example of FIG. 1, the material forming the two elements may be laminated to reduce the iron loss when the transformer is in use.

The two examples described have two slots only. A multiple of two slots may be provided. In such a case the windings are distributed between the slots the only requirement being that the direction of current flow in the portions of the windings in adjacent slots is in the opposite direction.

I Claim

1. An electrical transformer comprising a core structure formed from magnetizable material and at least a pair of electrical windings wound upon the core structure, one of said windings forming the primary winding of the transformer and the other winding or windings forming the secondary winding or windings, the core structure comprising a first element of tubular form which is shaped to define an even number of helical slots arranged in the manner of a two or a multiple of two, start thread, and a second element of tubular form extending across the open ends of said slots, each winding extending along one of said slots and returning along an adjacent slot and each of said slots having side walls and a base wall.

2. A transformer according to claim 1 in which said second element is of right cylindrical form and closely engages the first element.

3. A transformer according to claim 2 in which said slots open on the outer periphery of the first element, said first element also defining inwardly facing slots alternately arranged with said first mentioned slots.

4. A transformer according to claim 3 in which the wall of said first element and the second element is laminated.

5. A transformer according to claim 1 in which said second element defines helical projections which are disposed adjacent a side wall of said slots respectively.

6. A transformer according to claim 5 in which said first and second elements are relatively adjustable so as to introduce air gaps into the magnetic circuit constituted in part by the side walls and the base wall of each of said slots and a portion of the second element closing said slot.

7. A transformer according to claim 6 in which said elements are angularly adjustable relative to each other.

8. A transformer according to claim 6 in which said first element is constructed from thin material, the side walls defining the slots being in engagement with the side walls defining the adjacent slot or slots.

9. A transformer according to claim 6 in which said slots open onto the outer periphery of said first element.

10. A transformer according to claim 8 in which said material is laminated.

* * * * *